US008764011B2

(12) United States Patent
Michels et al.

(10) Patent No.: US 8,764,011 B2
(45) Date of Patent: Jul. 1, 2014

(54) DEVICE AND METHOD FOR HANDLING VALUE NOTES

(75) Inventors: André Michels, Borgentreich-Grosseneder (DE); Heinz Strohdiek, Paderborn (DE); René Hempel, Dresden (DE)

(73) Assignee: Wincor Nixdorf International GmbH (DE)

( * ) Notice: Subject to any disclaimer, the term of this patent is extended or adjusted under 35 U.S.C. 154(b) by 164 days.

(21) Appl. No.: 13/391,245

(22) PCT Filed: Aug. 20, 2010

(86) PCT No.: PCT/EP2010/062140

§ 371 (c)(1),
(2), (4) Date: Apr. 30, 2012

(87) PCT Pub. No.: WO2011/020904

PCT Pub. Date: Feb. 24, 2011

(65) Prior Publication Data

US 2012/0205221 A1 Aug. 16, 2012

(30) Foreign Application Priority Data

Aug. 20, 2009 (DE) ..... 10 2009 038 175

(51) Int. Cl.
*B65H 5/00* (2006.01)

(52) U.S. Cl.
USPC ..... 271/264; 271/306

(58) Field of Classification Search
USPC ..... 271/264, 306, 200
See application file for complete search history.

(56) References Cited

U.S. PATENT DOCUMENTS

| | | | | |
|---|---|---|---|---|
| 5,301,618 | A * | 4/1994 | Abendschein et al. | 109/55 |
| 7,357,389 | B2 | 4/2008 | Landwehr | |
| 7,357,391 | B2 | 4/2008 | Landwehr | |
| 7,395,766 | B2 | 7/2008 | Landwehr et al. | |
| 7,950,518 | B2 | 5/2011 | Fehrenbach et al. | |

(Continued)

FOREIGN PATENT DOCUMENTS

| | | |
|---|---|---|
| EP | 0332873 A1 | 9/1989 |
| EP | 0547308 A1 | 6/1993 |

(Continued)

OTHER PUBLICATIONS

International Search Report (in English) and Written Opinion (in German) for PCT/EP2010/062140, mailed Dec. 16, 2010; ISA/EP.

(Continued)

*Primary Examiner* — Michael McCullough
(74) *Attorney, Agent, or Firm* — Harness, Dickey & Pierce, P.L.C.

(57) ABSTRACT

The invention relates to a device (10) and a method for handling notes of value. The device comprises a first module (14) and a second module (12). The first module (14) is movable relative to the second module (12) and/or the second module (12) is movable relative to the first module (14) in at least one direction (P1, P2, P5). In a first operating state of the device (10), notes of value can be transported between the modules (12, 14). The second module (12) comprises at least one guiding element (24, 26, 100, 106) for guiding the notes of value during the transport of the notes of value between the modules (12, 14).

20 Claims, 7 Drawing Sheets

(56) References Cited

U.S. PATENT DOCUMENTS

| | | | | |
|---|---|---|---|---|
| 7,950,653 | B2 | 5/2011 | Berendes | |
| 7,954,816 | B2 | 6/2011 | Freitag et al. | |
| 2002/0074709 | A1 * | 6/2002 | Kanagawa | 271/3.14 |

FOREIGN PATENT DOCUMENTS

| | | | |
|---|---|---|---|
| EP | 1209633 | A2 | 5/2002 |
| EP | 1209633 | B1 | 10/2007 |
| EP | 2096062 | A2 | 9/2009 |
| EP | 2151805 | A1 | 2/2010 |
| TW | 505902 | B | 10/2002 |

OTHER PUBLICATIONS

Chinese Office Action for Application No. 2010800369105 dated Oct. 28, 2013 with English translation (21 pages).

* cited by examiner

DEVICE AND METHOD FOR HANDLING VALUE NOTES

CROSS-REFERENCE TO RELATED APPLICATIONS

This application is a U.S. National Stage of International Application No. PCT/EP2010/062140, filed Aug. 20, 2010, and published in German as WO 2011/020904 A1 on Feb. 24, 2011. This application claims the benefit and priority of German Application 10 2009 038 175.9, filed Aug. 20, 2009. The entire disclosures of the above applications are incorporated herein by reference.

BACKGROUND

This section provides background information related to the present disclosure which is not necessarily prior art.

TECHNICAL FIELD

The invention relates to a device for handling notes of value, comprising a first module and a second module. The modules respectively have a transport mechanism for transporting notes of value. The first module is movable relative to the second module and/or the second module is movable relative to the first module in at least one direction. In a first operating state of the device, the transport mechanism of the first module and/or the transport mechanism of the second module transports notes of value from the first module to the second module and/or from the second module to the first module. The second module comprises a guiding element for guiding notes of value during the transport of the notes of value from the first module to the second module or from the second module to the first module. In the first operating state of the device, the guiding element is aligned in an operating position for guiding the notes of value. In a second operating state, the first and the second module are moved relative to each other such that no notes of value can be transported from the first module to the second module or from the second module to the first module anymore. Further, the invention relates to a method for handling notes of value.

DISCUSSION

Known automated teller machines comprise a safe in which cashboxes filled with banknotes can be received. The safe has an opening through which banknotes removed from the cashboxes can be supplied from the safe to a head module and/or deposited banknotes can be supplied from the head module to the safe. The head module comprises in particular an input and output module, with the aid of which banknotes which are to be withdrawn are output to an operator and/or banknotes which are to be deposited are received by the operator. Both the head module and the safe respectively comprise a transport mechanism for transporting the notes of value. For the safe transfer of the notes of value between the safe and the head module the safe comprises two guiding elements between which the notes of value are guided during the transport from the safe to the head module and/or from the head module to the safe. The guiding elements project from the safe in the direction of the head module, in particular into the head module. For the mounting, demounting and maintenance the head module is designed such that it can be moved out of the automated teller machine relative to the safe. As the guiding elements of the safe, which project into the head module, are rigidly designed and arranged in a stationary and rotationally fixed manner in known devices, a respective free space has to be provided between the safe and the head module or inside the head module so that the head module is movable relative to the safe, without the guiding elements getting caught with elements of the head module and thus preventing a relative movement of the head module to the safe. This has the disadvantage that thereby much installation space is required which is thus not available for other component parts.

From Document EP 1 209 633 B1 an automated teller machine is known which has a banknote transport mechanism, comprising a first transport mechanism provided in a removable unit and a connection transport mechanism connected to said first transport mechanism. When the removable unit is removed the connection transport mechanism is actuable such that it controls the connection with the first transport mechanism. The connection transport mechanism comprises a guiding device which is configured for the engagement with the first transport mechanism for guiding the banknotes and provided with a second projection which is arranged on a position on which the guiding device comes into contact with a first projection provided on the removable unit. The first projection presses against the second projection to connect the connection transport mechanism to the first transport mechanism when the removable unit is installed into the device. When the removable unit is removed the guiding device is arranged in a non-operating position and is only brought in an operating position when the removable unit by the contact between the first and the second projection is moved in, in which operating position the notes of value can be transported with the aid of the transport mechanism. This has the disadvantage that installation space is required because of the first and the second projection, in particular when the removable unit is removed free space is required for the second projection provided in the removable unit so that said second projection does not get caught with other component parts. Further, it is a disadvantage that such a complex mechanism for raising and folding the guiding device is error-prone.

SUMMARY OF THE INVENTION

It is an object of the invention to specify a device and a method for handling notes of value in which two modules are easily movable relative to each other in a space-saving manner.

According to the invention when the modules are moved relative to each other at least a section of the guiding element by the contact to the first module is tilted over such in the direction of the second module that when the modules are moved relative to each other the guiding element at least temporarily contacts a surface of the first module facing the second module. In this way, the modules can be displaced relative to each other, without having to leave a free space between the modules or inside the first module to avoid that the guiding element gets caught with the first module when the modules are moved relative to each other and thus prevents a movement of the modules relative to each other. In particular, it is achieved in this way that the guiding element, which projects into the first module in the first operating position, when the modules are moved relative to each other is respectively tilted over so far in the direction of the second module by the contact to the first module that it contacts a surface of the first module element tilting over the guiding element, which surface faces the second module, and in doing so is tilted over exactly so far that the modules are movable relative to each other. The guiding element is in particular tilted over by the contact to the component parts of the first module facing the second module. Alternatively, the first module can also comprise a boundary wall which restricts the first module in the direction of the second module and the guiding element can be tilted over by the contact to said boundary wall. When the modules are moved relative to each other the guiding element slides in particular on the boundary wall.

As, according to the invention, in the second operating state of the device, the guiding element aligns in the operating position and does not contact the first module, it is not necessary to provide projections or similar elements on the modules which when the modules are moved relative to each other tilt the guiding elements over or raise the guiding elements again from a state, in which they are tilted over, in the operating position. In this way, the error-proneness is reduced, installation space is saved, the structure of the device is simplified and a module separation is easily realized.

In a preferred embodiment of the invention, in the second operating state of the device, the guiding elements automatically align in the operating position. By an automatic alignment of the guiding element is in particular understood that the guiding element is aligned in the operating position without actuating elements which are actuated when the modules are moved relative to each other.

The second module is or comprises in particular a safe for receiving cashboxes of an automated teller machine and the first module is or comprises in particular a head module, comprising an input and output unit for the input and output of banknotes. The head module is in particular mounted on rails and can be displaced relative to the stationary arranged safe. The first operating state is preferably said operating state of the automated teller machine in which the banknotes can be deposited and/or withdrawn. By displacing the head module relative to the safe, it is achieved that the head module can be easily mounted and demounted as well as that the transport mechanism of the head module is easily accessible for maintenance, in particular for the elimination of banknote jams. In an alternative embodiment of the invention, the second module can also be a safe of an automatic cash system or an automatic cash safe and the first module can also be a head module of the automatic cash system or the automatic cash safe.

In a preferred embodiment of the invention, the second module comprises a boundary wall which restricts the second module in the direction of the first module. The boundary wall includes an opening, in particular a slot, through which the notes of value can be transported during the transport of the notes of value from the first module to the second module and/or from the second module to the first module. The guiding element is in particular arranged on a lateral boundary of said opening. When the modules are moved relative to each other the guiding element is preferably tilted over such that it at least temporarily contacts the surface of the boundary wall facing the first module. In this way, it is achieved that the guiding element is tilted over as far as possible so that only a minimal free space is required between the first module and the second module.

It is advantageous when, when the modules are moved from the second operating state in the first operating state, at least a section of the guiding element is tilted over by the contact to the first module in the direction of the second module such that the guiding element at least temporarily contacts a surface of the first module facing the second module when the modules are moved relative to each other. In this way, it is achieved that the modules are also movable in the direction opposite to the direction in which they are moved from the first in the second operating state, without the guiding element getting caught with the first module, in particular with a component part of the first module. When the modules are moved from the second in the first operating state the guiding element is in particular tilted over in the direction reverse to the direction in which it is tilted over when the modules are moved from the first in the second operating state.

Further, it is advantageous when the guiding element comprises at least two, preferably more than two, spaced-apart guiding fingers for guiding the notes of value during the transport of the notes of value from the first module to the second module and/or from the second module to the first module, and when the transport mechanism of the first module comprises at least one transport element which is at least partially arranged between the guiding fingers in the first operating state. By arranging the transport element of the transport mechanism of the first module between the guiding fingers of the guiding element of the second module, it is achieved that the notes of value can be transported safely from the first module to the second module or from the second module to the first module and are not unintentionally diverted by a transport path formed by the transport mechanisms or get caught with the guiding fingers. The transport element is in particular also a guiding finger, a roll or a roller. By providing a plurality of spaced-apart guiding fingers and providing multiple guiding fingers in the first module which are respectively arranged between the guiding fingers of the guiding element of the second module, cogging is achieved guaranteeing a reliable transport of the notes of value.

In a preferred embodiment of the invention, at least an end portion of the guiding element facing the first module is elastic so that when the modules are moved relative to each other the first module bends at least the end portion of the guiding element by the contact to the end portion in the direction of the second module. Due to its elastic deformability the end portion aligns, in the first as well as in the second operating state, in the operating position. The operating position is in particular said position in which the guiding element is raised. When the modules are moved relative to each other the guiding element is bent from the raised position by the contact to the first module, whereby it is in particular only bent so far that the first module is movable relative to the second module or vice versa. As soon as the guiding element does not contact the first module anymore, the guiding element automatically aligns in the operating position again.

The end portion is in particular made of a material which has a high allowable strain and no or only a low creep behavior. The end portion is in particular made of a particulate organic matter (POM), a thermoplastic elastomer (TPU) and/or spring steel. In a preferred embodiment of the invention, the entire guiding element is made of the same material so that it can be easily produced, in particular by means of a spraying method. In this way, the production costs are reduced.

Further, it is advantageous when at least the end portion has such a decreasing wall thickness in the direction of the first module that the mechanical stress in the end portion is the same at every point when the guiding element is bent when the modules are moved relative to each other. In this way, it is achieved that at least the end portions of the guiding element, preferably the entire guiding element, form a body of equal strength. In this way, it is caused that at least the end portion of the guiding element exhibits a uniform stretch behavior and stress peaks and thus damage to material are prevented. Further, in this way it is achieved that the material requirements during the production of the guiding element are reduced.

In an alternative embodiment of the invention, the at least one guiding element is rotatably mounted about a rotational axis extending transversely to the direction in which the modules are movable relative to each other. The guiding element is held by at least one spring in the operating position in the first operating state and in the second operating state. When the modules are moved relative to each other the guiding element is rotated by the contact to the first module against the spring force of the spring about the rotational axis in the direction of the second module and is thus tilted over. In this way, it is achieved that the guiding element is tilted over, without the guiding element being elastically deformed here. In this way, creep behavior and other damage to material is prevented. Here, the guiding element is only tilted over as long as it contacts the first module. When there is no contact between the first module and the guiding element, the guiding element aligns again in the operating position due to the spring force of the spring.

It is advantageous when the guiding element comprises a shaft, the longitudinal axis of which coincides with the rotational axis, and at least two guiding fingers connected to the shaft in a rotationally fixed manner. The shaft rotatably held about the rotational axis is held via the spring such that the guiding fingers and thus the entire guiding element is aligned in the operating position. In this way, it is achieved that all guiding fingers are held in the operating position with the aid of only one spring. In an alternative embodiment of the invention, the shaft can also be arranged in a rotationally fixed manner and each finger can be spring-arranged via a separate spring so that, when the modules are moved relative to each other, the guiding fingers are tilted over by the contact to the first module.

Further, it is advantageous when the spring is a first spring and when a second spring is provided which holds the guiding element in the operating position. The second spring is in particular a leaf spring, wherein the leaf spring is preferably designed such that it causes only a slight locking of the guiding element in the operating position. By this second spring it is achieved that the guiding element does not already move out of its operating position in case of low forces. Such low forces can e.g. occur during the transport of the notes of value.

Further, it is advantageous when the guiding element is a first guiding element, the second module comprises a second guiding element for guiding the notes of value during the transport of the notes of value from the first module to the second module and/or from the second module to the first module, when the transport mechanism of the first module and/or the transport mechanism of the second module transports the notes of value during the transport of the notes of value from the first module to the second module and/or from the second module to the first module between the first guiding element and the second guiding element, when at least a portion of the second guiding element, in the first operating state of the device, projects into the first module, when, when the modules are moved relative to each other, the first module tilts at least a section of the second guiding element over by the contact to the guiding element in the direction of the second module such that when the modules are moved relative to each other the second guiding element at least temporarily contacts a surface of the first module facing the second module, when the second guiding element does not contact the first module anymore in the second operating state of the device, and when the second guiding element aligns in the operating position in the second operating state of the device. In this way, it is achieved that the banknotes to be transported are guided on both sides by respectively one guiding element during the transport from the first module to the second module and/or from the second module to the first module.

The first guiding element and the second guiding element can in particular be tilted over independently of each other.

Further, it is advantageous when the first module comprises a third guiding element for guiding the notes of value during the transport of the notes of value from the first module to the second module and/or from the second module to the first module, when, in the first operating state of the device, the third guiding element is aligned in an operating position for guiding the notes of value, when, in the first operating state of the device, at least a portion of the third guiding element projects into the second module, that when the modules are moved relative to each other the second module tilts at least a section of the third guiding element over by the contact to the guiding element such in the direction of the first module that when the modules are moved relative to each other the third guiding element at least temporarily contacts a surface of the second module facing the first module, when, in the second operating state of the device, the third guiding element does not contact the second module anymore, and when, in the second operating state of the device, the third guiding element aligns in the operating position. By providing such a third guiding element, the reliability of the guidance of the notes of value during the transport between the modules is increased.

Further, it is advantageous when the first module comprises a fourth guiding element for guiding the notes of value during the transport of the notes of value from the first module to the second module and/or from the second module to the first module, when, in the first operating state of the device, the fourth guiding element is aligned in an operating position for guiding the notes of value, when, in the first operating state of the device, at least a portion of the fourth guiding element projects into the second module, when, when the modules are moved relative to each other, the second module tilts at least a section of the fourth guiding element over by the contact to the guiding element such in the direction of the first module that when the modules are moved relative to each other the fourth guiding element at least temporarily contacts a surface of the second module facing the first module, when, in the second operating state of the device, the fourth guiding element does not contact the second module anymore, and when, in the second operating state of the device, the fourth guiding element aligns in the operating position. By providing such a fourth guiding element, it is achieved that the notes of value are reliably transported between the third and the fourth guiding element.

The second, the third and/or the fourth guiding element are in particular designed as indicated previously for the first guiding element. In particular, the second, the third as well as the fourth guiding element comprise a plurality of guiding fingers. The first and the third guiding element as well as the second and the fourth guiding element are in particular designed such and arranged to each other such that respectively one guiding finger of the third guiding element is arranged between two guiding fingers of the first guiding element and respectively one guiding finger of the fourth guiding element is arranged between two guiding fingers of the second guiding element. In this way, cogging between the first and the third guiding element or between the second and the fourth guiding element is achieved and thus a safe guidance of the notes of value is guaranteed. In an alternative embodiment of the invention, the guiding elements can also be differently designed.

The method specified can be developed in the same manner as the device. In particular, the method can be developed with the features on the device or with respective method features.

BRIEF DESCRIPTION OF THE DRAWINGS

Further features and advantages of the invention result from the following description which in connection with the enclosed Figures explains the invention in more detail with reference to embodiments.

The drawings described herein are for illustrative purposes only of selected embodiments and not all possible implementations, and are not intended to limit the scope of the present disclosure.

FIG. 10 shows a schematic sectional view of a detail of the automated teller machine according to FIGS. 1, 7 to 9 when the head module is moved in;

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
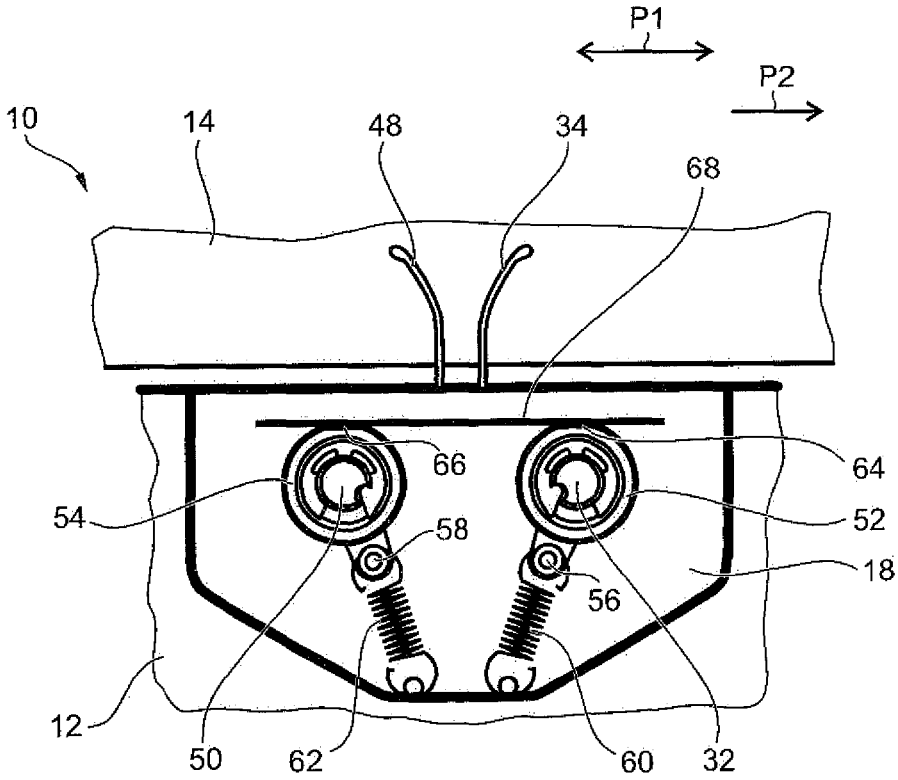
FIG. 1 shows a schematic illustration of a section through a detail of an automated teller machine in a first operating state.

In FIG. 1, a schematic sectional view of a detail of an automated teller machine 10 is shown in a first operating state. The automated teller machine 10 comprises a safe 12 and a head module 14. In the safe 12 a plurality of cashboxes for receiving banknotes can be received. Each cashbox has a separating and supply module assigned thereto via which banknotes can be supplied to the cashbox and banknotes can be removed from the cashbox and be supplied to a transport mechanism of the safe 12.

The head module 14 comprises an input and output unit for the output of banknotes which are to be withdrawn to an operator and for the input of banknotes which are deposited by an operator. Both the safe 12 and the head module 14 respectively have an opening through which the banknotes can be supplied from the head module 14 to the safe 12 or vice versa from the safe 12 to the head module 14. The safe 12 comprises a transport mechanism which connects the opening of the head module 14 with the input and output unit. The transport mechanism of the safe 12 connects the cashboxes received in the safe 12 to the opening of the safe 12.

In an alternative embodiment of the invention, the automated teller machine 10 can also serve only to withdraw banknotes. In this case, banknotes can exclusively be supplied to the head module 14 from the safe 12 via the opening of the safe 12 and the opening of the head module 14. In a further alternative embodiment of the invention, the safe 12 and the head module 14 can also be a safe and a head module of an automatic cash system or an automatic cash safe.

In the first operating state of the automated teller machine 10, illustrated in FIG. 1, the safe 12 and the head module 14 are arranged to each other such that the opening of the safe 12 and the opening of the head module 14 face each other so that the banknotes can be transported between the safe 12 and the head module 14. Further, the automated teller machine 10 comprises a transfer transport unit 16 which serves to guide the banknotes during the transfer of the banknotes from the head module 14 to the safe 12 or from the safe 12 to the head module 14.

Figure 2:
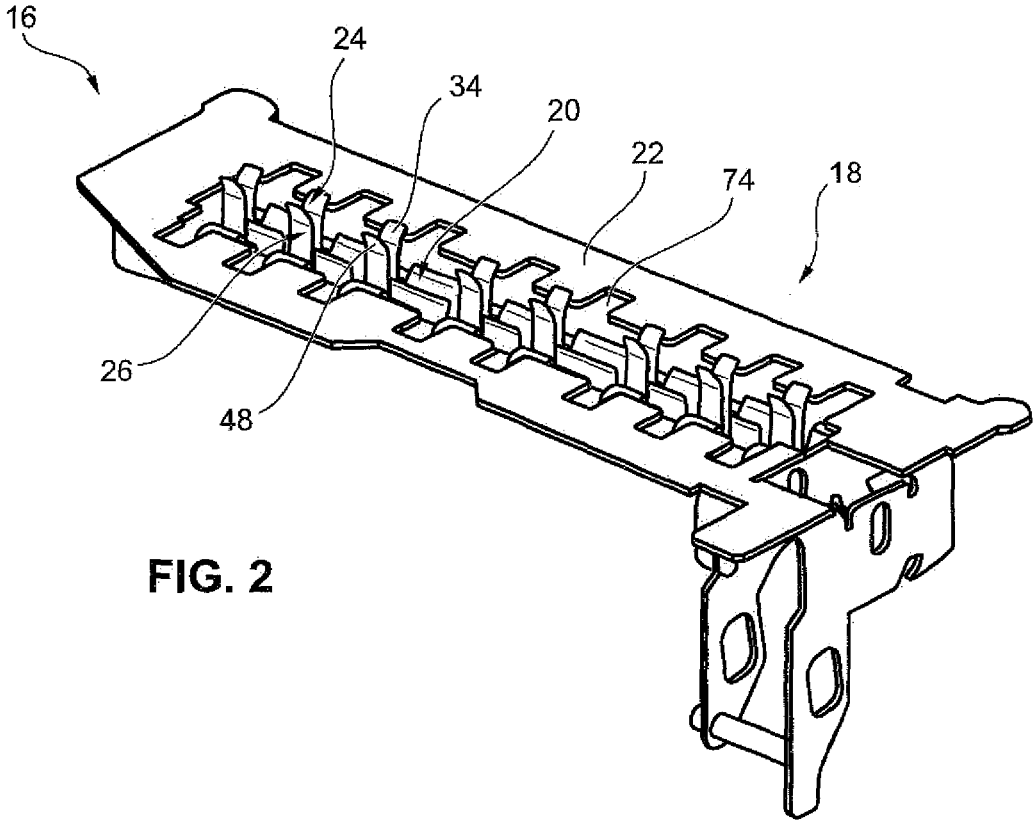
FIG. 2 shows a schematic perspective illustration of a transfer transport unit of a safe of the automated teller machine.

In FIG. 2, a schematic perspective illustration of such a transfer transport unit 16 is illustrated. Elements having the same structure or the same function are identified with the same reference signs. The transfer transport unit 16 is inserted into the opening of the safe 12 and comprises a housing unit 18 which is fixedly connected to the safe 12. The housing unit 18 has a cover element 22 including a slot 20 via which cover element 22 the opening of the safe 12 is at least partially covered. The banknotes are transported through the slot 20 during the transport from the safe 12 to the head module 14 or during the transport from the head module 14 to the safe 12. Here, the banknotes are in particular transported aligned such that the long side thereof is aligned transversely to the transport direction, i.e. in a so-called "long side first"-alignment.

Further, the transfer transport unit 16 comprises two guiding elements 24, 26 for guiding the banknotes during the transport of the banknotes from the safe 12 to the head module 14 and from the head module 14 to the safe 12. The banknotes are here transported between the guiding elements 24, 26 so that the banknotes are guided on both sides by respectively one guiding element 24, 26. In this way, a safe transfer of the banknotes from the head module 14 to the safe 12 or from the safe 12 to the head module 14 is guaranteed and banknote jams are prevented.

Figure 3:
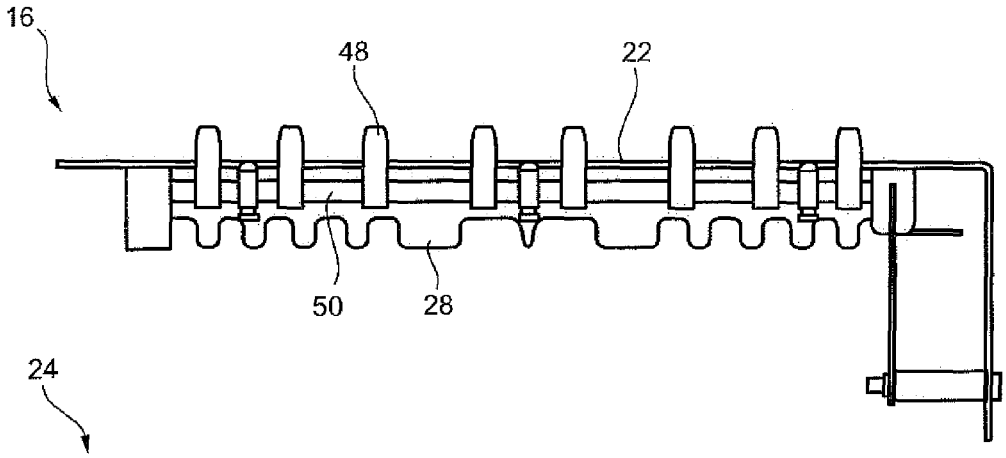
FIG. 3 shows a schematic side view of the transfer transport unit according to FIG. 2.

In FIG. 3, a schematic side view of the transfer transport unit 16 according to FIG. 2 is shown. The transfer transport unit 16 further comprises two sliding elements 28, 30 which are respectively arranged on one side of the slot 20 and between which the banknotes are transported, whereby they are guided by the sliding elements 28, 30.

Figure 4:
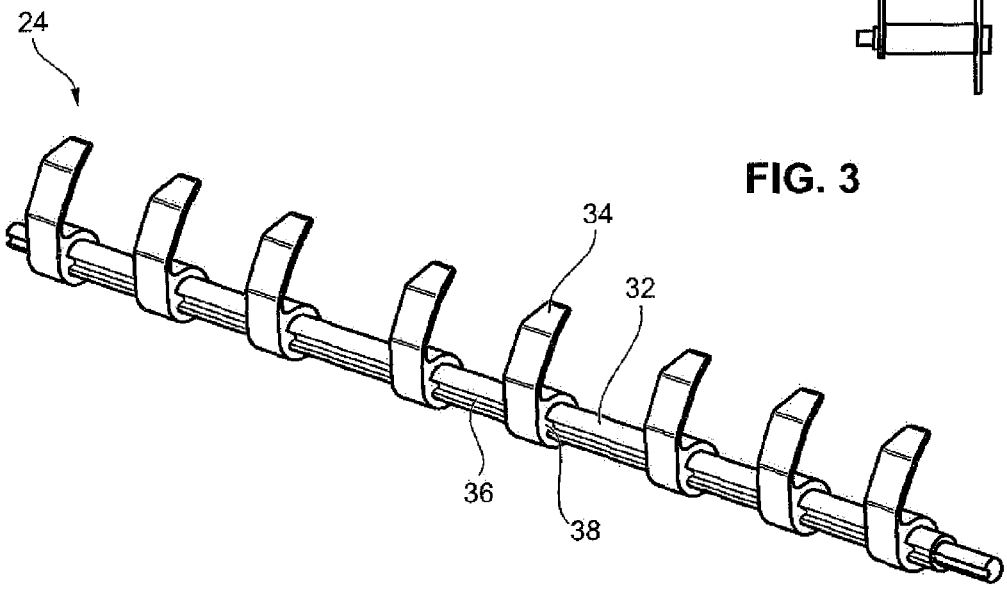
FIG. 4 shows a schematic perspective illustration of a guiding element of the transfer transport unit according to FIGS. 1 and 2.

In FIG. 4, a schematic perspective illustration of the first guiding element 24 according to FIGS. 2 and 3 is shown. The second guiding element 26 is preferably designed identically to the first guiding element 24.

The first guiding element 24 comprises a shaft 32 and eight guiding fingers, one of which is exemplarily identified with the reference sign 34. In an alternative embodiment of the invention, the guiding element 24 can also comprise more or less than eight guiding fingers 34. The guiding fingers 34 of the guiding element 24 are in particular identically designed. However, alternatively the guiding fingers 34 can also be differently designed. In a further alternative embodiment of the invention, the guiding element 24 can also comprise a continuous plate-shaped element for guiding the banknotes instead of a plurality of guiding fingers 34.

The guiding fingers 34 are connected to the shaft 32 in a rotationally fixed manner. For this, the shaft 32 includes a groove 36 extending in the axial direction, into which groove 36 respectively one projection 38 of a guiding finger 34 projects so that the guiding fingers 34 are engaged with the groove 36 via the projections 38 and are thus not rotatable relative to the shaft 32.

Figure 5:
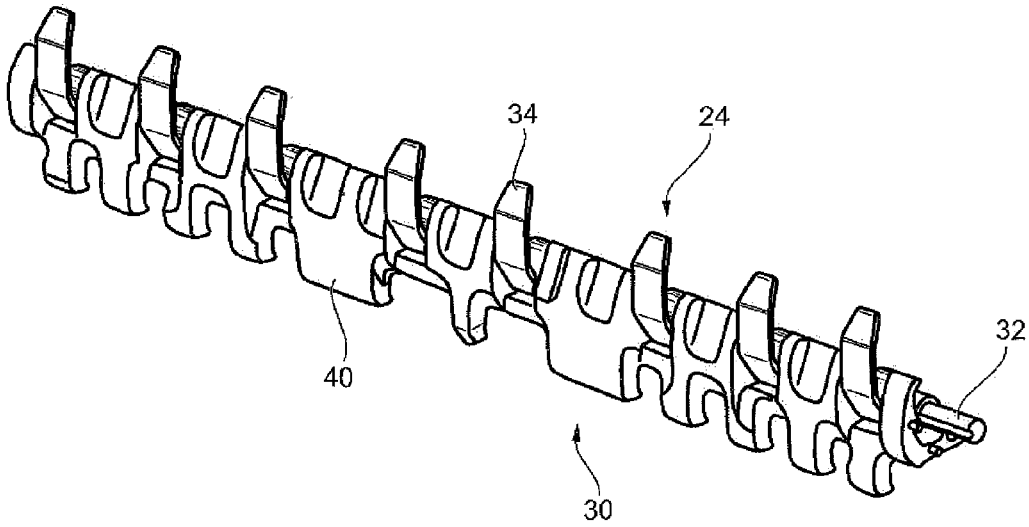
FIG. 5 shows a schematic perspective illustration of the guiding element according to FIG. 4 and a further guiding element for guiding notes of value.

In FIG. 5, a schematic perspective illustration of the first guiding element 24 according to FIG. 4 and the sliding element 30 is illustrated. The guiding element 24 is rotatably mounted relative to the sliding element 30, whereas the sliding element 30 is connected to the housing unit 18 in a stationary manner and thus connected to the safe 12 in a stationary manner. The guiding element 24 is here in particular mounted such that it is rotatable in both directions about the longitudinal axis of the shaft 32.

The guiding fingers 34 are arranged on the shaft 32 such that two adjacent guiding elements 34 are respectively spaced to each other. The sliding element 30 includes a plurality of sliding surfaces 40, wherein the sliding surfaces 40 are respectively arranged between two guiding fingers 34. In this way, it is achieved that the guiding fingers 34 are rotated during a rotation of the shaft 32, without being prevented therefrom by the sliding surfaces 40 of the sliding element 30. The second sliding element 28 is in particular designed identically to the first sliding element 24.

Figure 6:
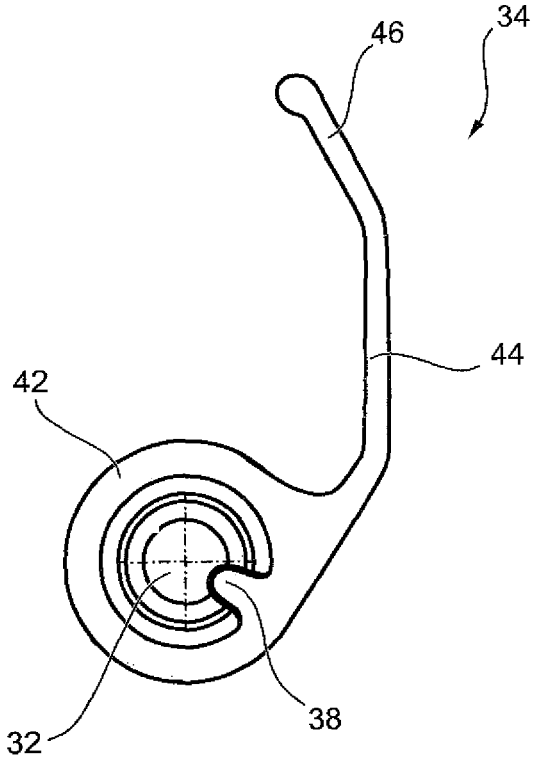
FIG. 6 shows a schematic side view of a guiding finger of the guiding element according to FIGS. 4 and 5.

In FIG. 6, a side view of a guiding finger 34 is illustrated. The guiding finger 34 comprises an approximately hollow-cylindrically designed basic body 42, a first guiding portion 44 and a second guiding portion 46. The basic body 42 and the guiding portions 44, 46 are in particular formed integrally. The guiding finger 34 is mounted on the shaft 32 via the basic body 42, wherein the guiding finger 34 is in particular stuck on the shaft 32 such that the shaft 32 extends through the opening of the hollow-cylindrical basic body 42. The basic body 42 is in particular made of an at least slightly elastic material and has an inner diameter which is slightly smaller than the outer diameter of the shaft 32, such that an axial slipping of the guiding finger 34 is prevented.

In the first operating state of the automated teller machine 10, the guiding elements 24, 26 and thus the guiding fingers 34 are arranged in an operating position in which banknotes are transported between the guiding elements 24, 26 which are guided by the guiding fingers 34 during the transport. In the operating position, the guiding fingers are in particular aligned such that the first guiding portion 44 extends approximately parallel to the sliding surfaces 40 of the sliding elements 28, 30. The second guiding portion 46 is bent relative to the first guiding portion 44 by an angle away from the transport path on which the banknotes are transported. In this way, it is achieved that the distance between two guiding fingers 34, positioned opposite to each other, is greater at the end of the guiding fingers 34 facing away from the shaft 32 than the distance between the first guiding portions 44 of guiding elements 44 positioned opposite to each other. Thus, banknotes supplied from the head module 14 to the safe 12 are safely transported between the guiding elements 24, 26 and do not get jammed with the ends of the guiding fingers 34 facing the head module 14.

As already mentioned, in the first operating state of the automated teller machine 10, shown in FIG. 1, the guiding elements 24, 26 are aligned in the operating position. The operating position is in particular said position in which the guiding fingers 34 are raised. In the operating position, respectively at least one portion of each guiding finger 34, 48 projects into the head module 14. In this way, a safe transfer of the banknotes between the transport mechanism of the safe 12 and the transport mechanism of the head module 14 is guaranteed. The transport mechanism of the head module 14 comprises in particular transport elements, which are respectively arranged between the portions of two adjacent guiding fingers 34, 48 of a guiding element 24, 26 projecting into the head module 14. In this way, it is achieved that the banknotes to be transported are laterally guided at any time. Further, in this way, it is prevented that the banknotes to be transported can be jammed with the ends of the guiding elements 34, 48.

At respectively one end portion of the shafts 32, 50 of the guiding elements 24, 36 respectively one attachment 52, 54 connected to the shaft 32, 50 in a rotationally fixed manner is arranged. The attachments 52, 54 respectively include one engagement element 56, 58 which is respectively engaged with a first end of a tension spring 60, 62. The second ends of the tension springs 60, 62, opposite to the first end, are fixedly connected to the housing unit 18 and thus to the safe 12. The guiding elements 24, 26 are held in the operating position via the tension springs 60, 62. For this, the tension springs 60, 62 are in particular arranged in a slightly pre-stressed manner in the first operating state of the automated teller machine 10.

Further, the attachments 52, 54 respectively include a flat portion 64, 66 against which a leaf spring 68 rests in the operating position of the guiding elements 24, 26. Via the leaf spring 68 the guiding elements 24, 26 are held in the operating position in addition to the tension springs 60, 62. For pivoting the guiding elements 24, 26 out of the operating position by a rotation of the shafts 32, 50, the leaf spring 68 has to be slightly deformed or lifted against the spring force thereof so that a slight locking of the guiding elements 24, 26 in the operating position by the leaf spring 68 takes place. In this way, it is prevented that the guiding elements 24, 26 unintentionally twist from the operating position, e.g. because of the forces caused by the banknotes to be transported between them. In an alternative embodiment of the invention, a leaf spring 68 can also be dispensed with and the alignment of the guiding elements 24, 26, in the first operating state of the automated teller machine 10, in the operating position can take place exclusively via the tension springs 60, 62.

In a further alternative embodiment of the invention, the shafts 32, 50 can also be connected to the housing unit 18 in a rotationally fixed manner and each guiding finger 34, 48 can individually be spring-connected to the shaft 32, 50 via respectively one tension spring, wherein each guiding finger 34, 48 can be held in the operating position by the respective spring. The head module 14 is in particular mounted on rails and movable in the direction of the double arrow P1 relative to the safe 12 arranged in a stationary manner. In this way, easy mounting and demounting of the head module 14 is achieved and the maintenance of the automated teller machine 10 is made easier. Occurring banknote jams can be easily eliminated by pulling the head module 14 in the direction of the arrow P2 at least partially out of the automated teller machine 10.

Figure 7:
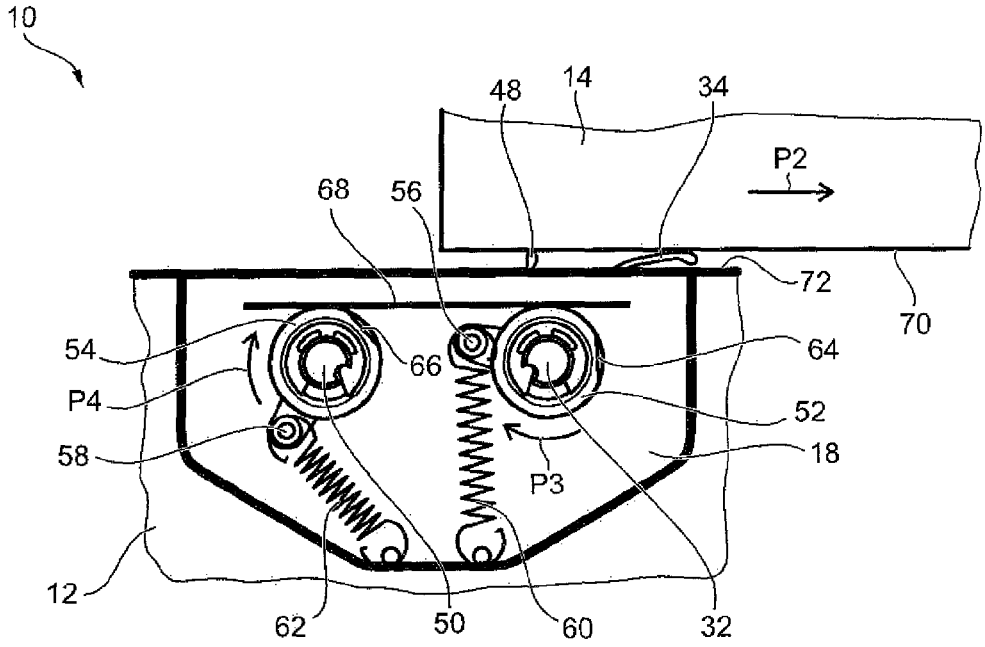
FIG. 7 shows a schematic sectional view of a detail of the automated teller machine according to FIG. 1 when a head module is pulled out.

In FIG. 7, a schematic sectional view of a detail of the automated teller machine 10 is shown when the head module 14 is pulled out. When the head module 14 is moved relative to the safe 12 the guiding fingers 34, 48 are tilted over about the rotational axis of the shaft 32 or 50 in the direction of the arrow P2 by the contact to the head module 14 such that they do not project into the head module 14 anymore. Here, the guiding fingers 34, 48 are in particular tilted over such that they contact the surface 70 of the head module 14 facing the safe 12 and in particular slide on the surface 70. In this way, it is achieved that only a minimal space between the head module 14 and the safe 12 is required for the guiding fingers 34, 48 when the head module 14 is moved relative to the safe 12 and thus valuable installation space is saved which can be used for other elements. The guiding elements 34, 48 are preferably deflected so far that at least the guiding fingers 34 of the front guiding element 24 as viewed in the displacement direction P2 are tilted over so far that they contact the surface 72 of the safe 12 facing the head module 14.

When the guiding fingers 34, 48 are tilted over the guiding elements 24, 26 are rotated against the spring forces of the tension springs 60, 62. When the head module 12 is displaced in the displacement direction P2 the shafts 32, 50 of the guiding elements 24, 26 are, as illustrated in FIG. 7, turned clockwise in the direction of the arrows P3 or P4. By the rotation of the guiding elements 24, 26, the tension springs 60, 62 are stressed so that the spring force becomes the greater the further the guiding elements 24, 26 are rotated out of the operating position.

Figure 8:
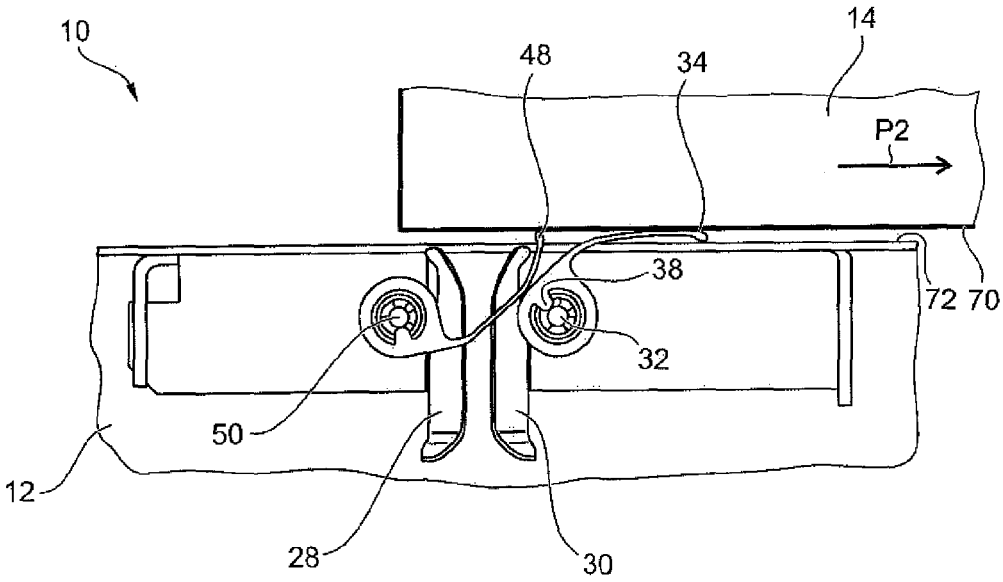
FIG. 8 shows a further schematic sectional view of a detail of the automated teller machine according to FIGS. 1 and 7 when the head module is pulled out.

In FIG. 8, a further schematic sectional view of a detail of the automated teller machine 10 when the head module 14 is pulled out in the displacement direction P2 is shown. In the illustration shown in FIG. 8, the alignment of the guiding elements 34, 48 when the head module 14 is pulled out is shown. The guiding finger 48 is rotated in the direction of the arrow P4 so far that it contacts the guiding finger 34. The guiding finger 48 is rotated out of the operating position so far that the end thereof facing away from the shaft 32 contacts the surface 72 of the safe 12. The cover element 22 of the housing unit 18 includes several recesses, one of which is exemplarily identified with the reference sign 74 in FIG. 2. The recesses 74 are arranged such that the guiding fingers 34, 48 can be rotated out of the operating position as far as possible, without being impeded in the process by the cover element 22.

Figure 9:
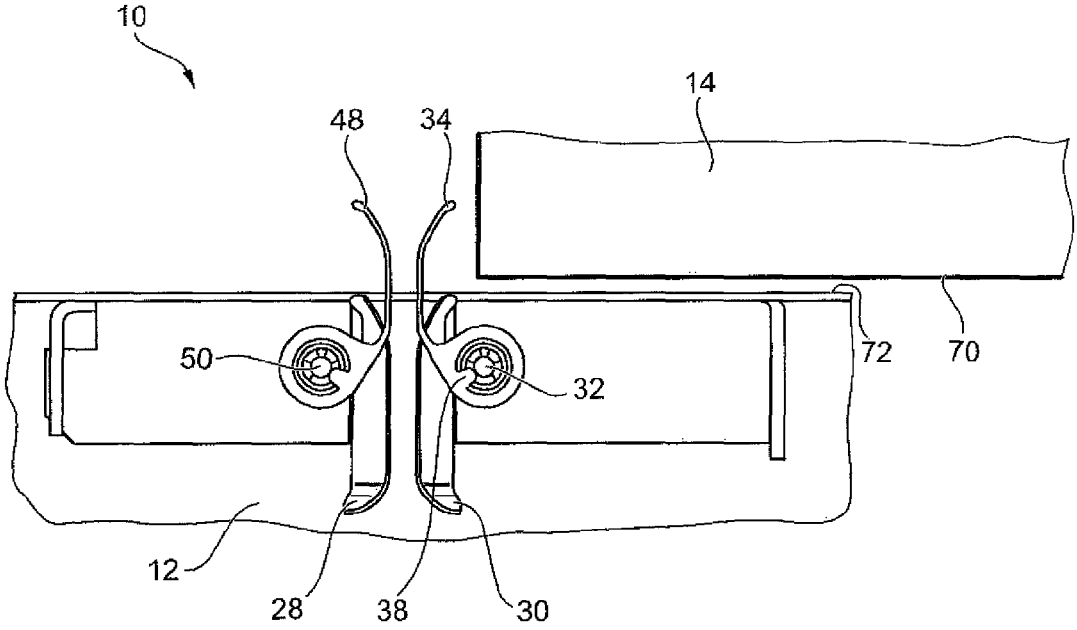
FIG. 9 shows a schematic sectional view of a detail of the automated teller machine according to FIGS. 1, 7 and 8 in a second operating state.

In FIG. 9, a schematic sectional view of a detail of an automated teller machine 10 in a second operating state is shown. In the second operating state, the head module 14 is pulled out of the automated teller machine 10 relative to the safe 12 so far that the guiding elements 24, 26 do not contact the head module 14 anymore. In the second operating state, no notes of value can be transported between the head module 14 and the safe 12. The second operating state is in particular said operating state in which the automated teller machine 10 is accessible for maintenance.

Due to the spring forces of the tension springs 60, 62, in the second operating state of the automated teller machine 10, the guiding elements 24, 26 align automatically again in the operating position as they do not contact the head module 14 anymore. Due to the spring forces this raising of the guiding elements 24, 26 takes place automatically, without an actuating mechanism having to be actuated for this.

In an alternative embodiment of the invention, the head module 14 can, other than illustrated in FIG. 9, in the second operating state, also only be displaced so far with respect to the safe 12 that the guiding fingers 34, 36 still project into the head module 14, but are not tilted over by the head module 14 anymore. In a further alternative embodiment of the invention, the head module 14 can also not include a boundary wall in the direction of the safe 12. In this case, the guiding elements 24, 26 are not tilted over by the contact to the boundary wall of the head module 14 facing the safe 12, but are tilted over by surfaces of component parts of the head module 14 facing the safe 12. Here, the guiding elements 24, 26 are in particular tilted over so far that they contact the surfaces of the component parts and rise again after the contact with one of said component parts as far as the next adjacent component part of the head module 14 permits it. Thus, it is in particular achieved that the guiding fingers 34, 48 slide on component parts of the head module 12 facing the safe 12 at any time so that a displacement of the head module 14 relative to the safe 12 is possible.

Figure 10:
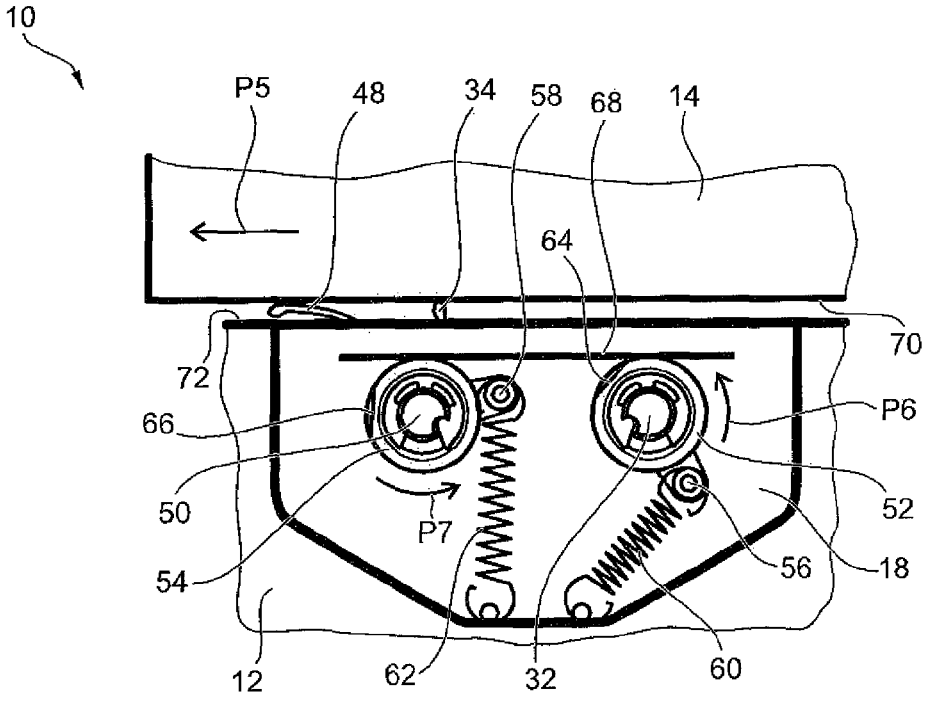

In FIG. 10, a schematic sectional view of a detail of the automated teller machine 10 is shown when the head module 14 is pushed in from the second operating state in the first operating state in the direction of the arrow P5. When the head module 14 is displaced in the direction of the arrow P5 the guiding fingers 34, 48 are tilted over in the direction of the arrow P5 by the contact to the head module 14. Here, the guiding elements 24, 36 and thus the shafts 32, 50 are rotated anticlockwise in the direction of the arrows P6 and P7 against the spring forces of the tension springs 60, 62. After the head module 14 has been displaced so far in the direction of the arrow P5 again that the head module 14 is arranged in the first operating state, the guiding elements 24, 26 automatically rise again in the operating position by the spring forces of the tension springs 60, 62, i.e. the guiding elements 24, 26 rise again.

Figure 11:
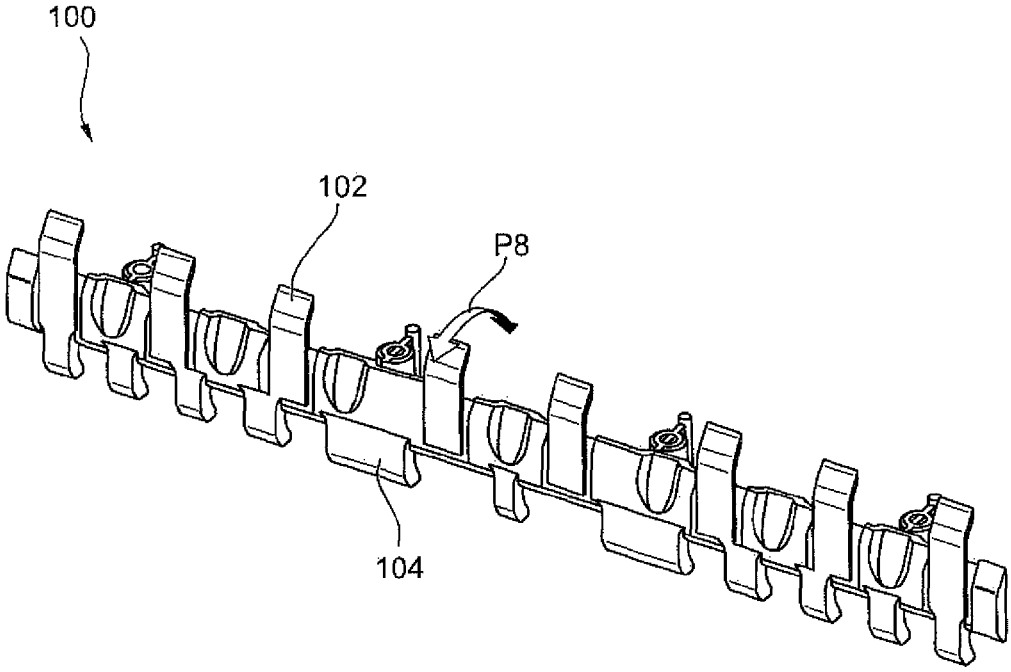
FIG. 11 shows a schematic perspective illustration of a guiding element according to a further embodiment of the invention.
Figure 12:
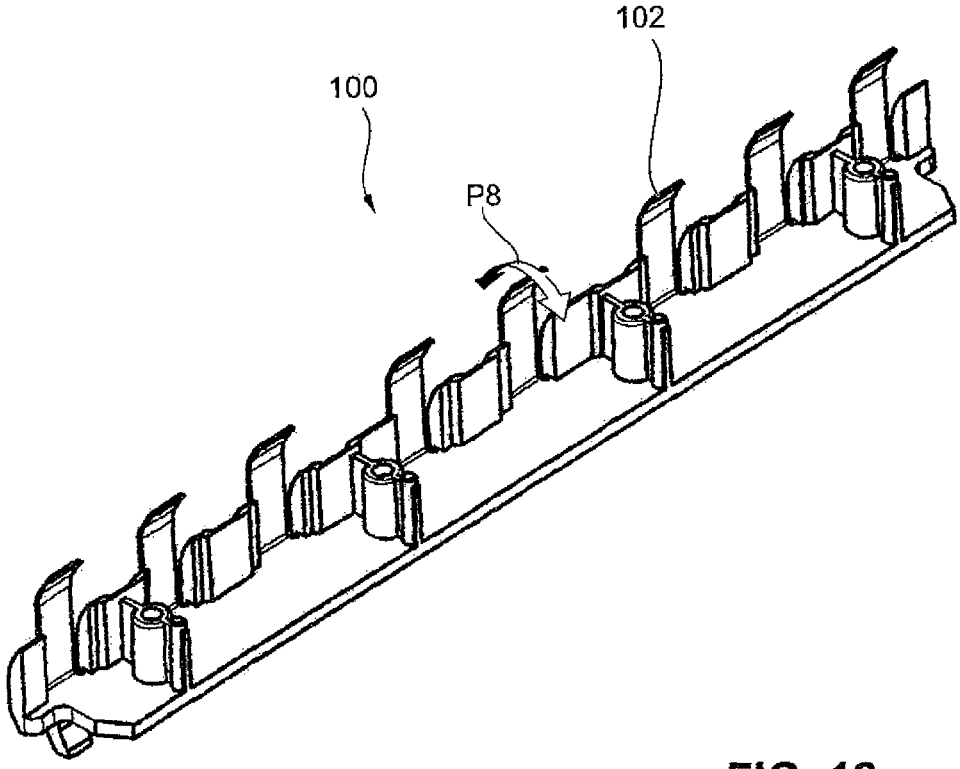
FIG. 12 shows a further schematic perspective illustration of the guiding element according to FIG. 11.

In FIG. 11, a schematic perspective illustration of a guiding element 100 according to a further embodiment of the invention is illustrated. In FIG. 12, a further schematic perspective illustration of the guiding element 100 according to FIG. 11 is shown. The guiding element 100 comprises eight guiding fingers, one of which is exemplarily identified with the reference sign 102. Alternatively, the guiding element 100 can also comprise more or less than eight guiding fingers 102. Further, the guiding element 100 has a plurality of guiding walls, one of which is exemplarily identified with the reference sign 104. The guiding walls 104 serve, as well as the guiding fingers 102, to guide the banknotes during the transport of the banknotes.

When installed in the safe 12, the guiding walls 104 face away from the head module 14, whereas the guiding fingers 102 project into the head module 14. The guiding fingers 102 are so elastic that they are at least elastically deformable in the direction of the double arrow P8. The entire guiding element 100 is in particular formed integrally and made of the same material. The guiding element 100 is preferably produced by means of a spraying method of a material which has a high allowable strain and a low or no creep behavior. In this way, an easy and cost-efficient production of the guiding element 100 is achieved. In particular particulate organic matters (POM), thermoplastic elastomers (TPU) and/or spring steel are used as material for the guiding element 100.

Figure 13:
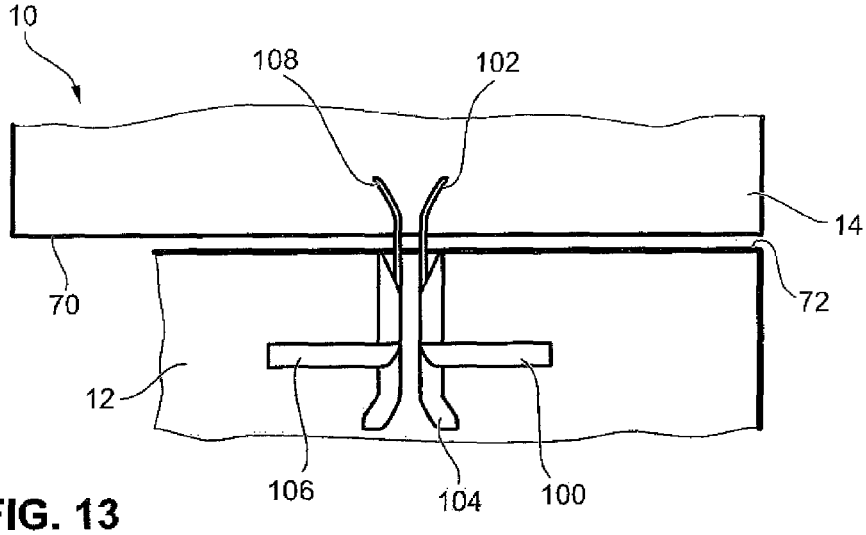
FIG. 13 shows a schematic sectional view of a detail of an automated teller machine, comprising a guiding element according to FIGS. 11 and 12 in the first operating state.

In FIG. 13, a schematic sectional view of a detail of the automated teller machine 10 in the first operating state is illustrated. Two guiding elements 100, 106 are arranged on the safe 12 of the automated teller machine 10, wherein the banknotes are transported between the guiding elements 100, 102 during the transfer of the banknotes between the safe 12 and the head module 14. The guiding elements 100 and 106 are in particular identically designed. In an alternative embodiment of the invention, the guiding elements 100 and 106 can also be differently designed. The guiding fingers 102, 108 are, in the first operating state, arranged in an operating position and project into the head module 14 in said operating position. In the operating position, banknotes can be transported between the head module 14 and the safe 12. In the operating position, the guiding fingers 102, 108 are in particular aligned such that they are raised.

Figure 14:
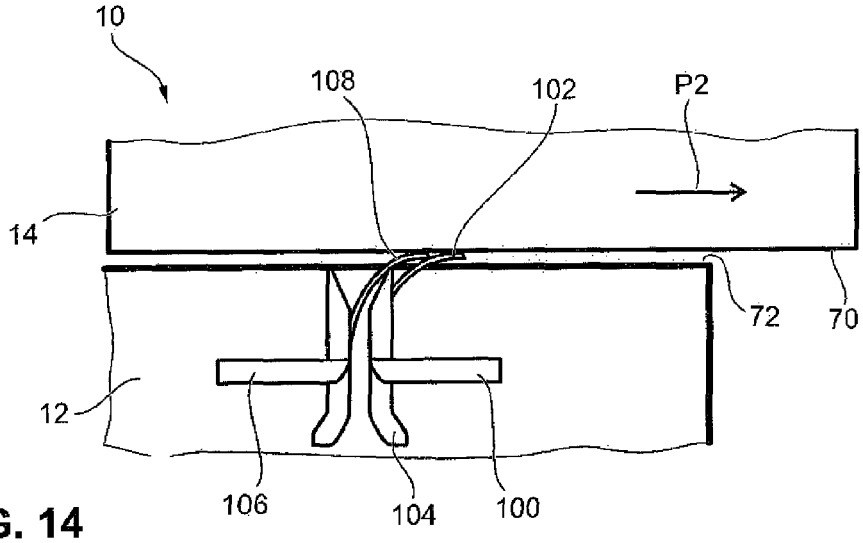
FIG. 14 shows a schematic sectional view of a detail of the automated teller machine according to FIG. 13 when the head module is pulled out.

In FIG. 14, a schematic sectional view of a detail of the automated teller machine 10 according to FIG. 13 when the head module is displaced from the first operating state to the second operating state in the direction of the arrow P2 is illustrated. When the head module 14 is displaced relative to the safe 12 the guiding fingers 102, 108 are elastically deformed by the contact to the head module 14 such that they do not project into the head module 14 anymore, but slide along a surface facing the safe 12 or along the surfaces of component parts of the head module 14 facing the safe 12 when the head module 14 is displaced. The guiding fingers 102, 108 are in particular designed such that they are only elastically and not plastically deformed here.

In a preferred embodiment of the invention, the guiding fingers 102, 108 are designed as bodies of equal strength so that the same tensions are acting at each point of the guiding fingers 102, 108 when the head module 14 is displaced relative to the safe 12. Hereby, a uniform stretch behavior of the guiding fingers 102, 108 is caused via the cross section of the guiding fingers 102, 108, whereby a damage of the guiding fingers 102, 108 is prevented. To obtain a body of equal strength the guiding fingers 102, 108 are in particular designed such that the wall thickness of the guiding fingers 102, 108 increases from the ends of the guiding fingers 102, 108 facing away from the guiding walls 104 towards the guiding walls 104.

Figure 15:
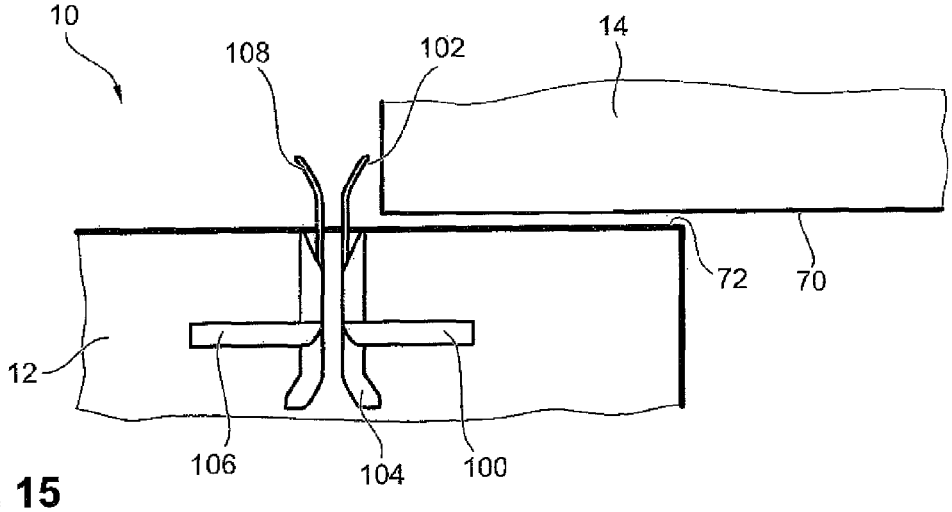
FIG. 15 shows a schematic sectional view of a detail of the automated teller machine according to FIGS. 13 and 14 in the second operating state.

In FIG. 15, a schematic sectional view of a detail of the automated teller machine 10 according to FIGS. 13 and 14 in the second operating state is illustrated. In the second operating state, the head module 14 is moved so far in the direction of the arrow P2 relative to the safe 12 that the guiding fingers 102, 108 do not contact the head module 14 anymore. Due to their elasticity, in the second operating state, the guiding fingers 102, 108 align again in the operating position, i.e. the guiding fingers 102, 108 rise again.

When the head module 14 is moved in against the direction P2 the guiding fingers 102, 108 are elastically bent in the opposite direction as compared to FIG. 14 so that they contact the surface 70 of the head module 14 facing the safe 12. When the head module 14 is displaced again from the second operating state in the first operating state, the guiding fingers 102, 108 align again in the operating position so that banknotes can again be transported between the head module 14 and the safe 12. The alignment of the guiding fingers 102, 108 in the operating position takes place both in the first and in the second operating state automatically due to the elasticity of the guiding fingers 102, 108.

In an alternative embodiment of the invention, the safe 12 can also be movable relative to the head module 14 and the head module 14 can be arranged in a stationary manner. Alternatively, both the head module 14 and the safe 12 can also be movably arranged.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed:

1. A device for handling notes of value comprising:

a first module including a transport mechanism for transporting notes of value; and a second module including a transport mechanism for transporting notes of value;

wherein:

at least one of the first module is movable relative to the second module, or the second module is movable relative to the first module in at least one direction;

in a first operating state of the device, at least one of the transport mechanism of the first module or the transport mechanism of the second module transport notes of value from at least one of the first module to the second module, or from the second module to the first module;

the second module comprises at least one guiding element for guiding the notes of value during the transport of the notes of value from at least one of the first module to the second module or from the second module to the first module;

in the first operating state of the device, the at least one guiding element is aligned in an operating position for guiding the notes of value;

in the first operating state of the device, at least a portion of the at least one guiding element projects into the first module;

when the modules are moved relative to each other the first module tilts at least a section of the at least one guiding element over by the contact to the at least one guiding element such in the direction of the second module that when the modules are moved relative to each other the at least one guiding element at least temporarily contacts a surface of the first module facing the second module;

in a second operating state, the first module and the second module are moved relative to each other such that no notes of value can be transported from at least one of the first module to the second module or from the second module to the first module;

in the second operating state of the device, the at least one guiding element does not contact the first module and aligns in the operating position;

the second module includes a boundary wall that restricts the second module in the direction of the first module, and that the boundary wall includes an opening through which opening the notes of value can be transported during the transport of the notes of value from at least one of the first module to the second module or from the second module to the first module; and when the modules are moved relative to each other the at least one guiding element is tilted over such that it at least temporarily contacts the surface of the boundary wall facing the first module.

2. The device according to claim 1, wherein the second operating state of the device, the at least one guiding element aligns automatically in the operating position.

3. The device according to claim 1, wherein the second module is a safe for receiving cash boxes of an automated teller machine, and that the first module is a head module of the automated teller machine, comprising an input and output unit for the input and/or the output of notes of value.

4. The device according to claim 3, wherein the head module is displaceable relative to the safe, and that the first operating state is said operating state of the automated teller machine in which notes of value can be at least one of deposited or withdrawn.

5. The device according to claim 1, wherein the modules are moved from the second operating state in the first operating state the first module tilts at least a section of the at least one guiding element over by the contact to the at least one guiding element such in the direction of the second module that when the modules are moved relative to each other the at least one guiding element at least temporarily contacts a surface of the first module facing the second module.

6. The device according to claim 1, wherein the at least one guiding element comprises at least two spaced-apart guiding fingers for guiding the notes of value during the transport of the notes of value from at least one of the first module to the second module or from the second module to the first module, and that the transport mechanism of the first module comprises at least one transport element which is at least partially arranged between the guiding fingers in the first operating state.

7. The device according to claim 1, wherein at least an end portion of the at least one guiding element facing the first module is elastic so that when the modules are moved relative to each other the first module bends at least the end portion of the at least one guiding element by the contact to the end portion in the direction of the second module.

8. The device according to claim 7, wherein at least the end portion is made of at least one of a particulate organic matter, a thermoplastic elastomer, or spring steel.

9. The device according to claim 1, wherein at least one of the at least one guiding element is rotatably mounted about a rotational axis extending transversely to the direction in which the modules are movable relative to each other, that the at least one guiding element, in the first operating state and in the second operating state, is held by at least one spring in the operating position, and that when the modules are moved relative to each other the first module rotates the at least one guiding element by the contact to the at least one guiding element against the spring force of the spring about the rotational axis in the direction of the second module.

10. The device according to claim 9, wherein the guiding element comprises a shaft, the longitudinal axis of which coincides with the rotational axis, and at least two guiding fingers connected to the shaft in a rotationally fixed manner.

11. The device according to claim 9, wherein the spring is a first spring, and that a second spring is provided which holds the guiding element in the operating position.

12. A method for handling notes of value comprising:

transporting in a first operating state, by means of at least one of a transport mechanism of a first module or by means of a transport mechanism of a second module notes of value from at least one of the first module to the second module or from the second module to the first module;

during the transport from at least one of the first module to the second module or from the second module to the first module, guiding the notes of value by at least one guiding element of the second module, which at least one guiding element, in the first operating state, is aligned in an operating position for guiding the notes of value during the transport of the notes of value from at least one of the first module to the second module or from the second module to the first module, wherein a portion of the at least one guiding element projects into the first module in the first operating state;

at least one of moving the first module relative to the second module or moving the second module relative to the first module in at least one direction in a second operating state;

transporting no notes of value from at least one of the first module to the second module or from the second module to the first module in the second operating state;

tilting at least a section of the at least one guiding element in the direction of the second module by the contact to the first module such that when the modules are moved relative to each other the at least one guiding element at least temporarily contacts a surface of the first module facing the second module;

aligning the at least one guiding element in the operating position at least one of due to the intrinsic elasticity thereof or by means of an elastic element in the second operating state;

wherein the second module includes a boundary wall that restricts the second module in the direction of the first module, and that the boundary wall includes an opening through which opening the notes of value can be transported during the transport of the notes of value from at least one of the first module to the second module or from the second module to the first module; and wherein when the modules are moved relative to each other the at least one guiding element is tilted over such that it at least temporarily contacts the surface of the boundary wall facing the first module.

13. A device for handling notes of value comprising:

a first module including a first transport mechanism for transporting notes of value;

a second module including a second transport mechanism for transporting notes of value between the first and the second modules, the first and the second modules are movable relative to each other;

a boundary wall of the second module configured to restrict the second module in the direction of the first module, the boundary wall defining an opening through which the notes of value can be transported; and at least one guiding element included with the second module configured to guide the notes of value during transport of the notes of value between the first and the second modules;

wherein:

in a first operating configuration, the first and the second modules are arranged to permit transport of notes of value therebetween, and the at least one guiding element extends into the first module and is aligned in an operating position for guiding the notes of value;

in a second operating configuration, the at least one guiding element does not contact the first module, the first and the second modules are arranged to restrict transport of notes of value therebetween, and the at least one guiding element is aligned in the operating position; and the first and the second modules are configured such that during relative movement between the first and the second modules the first module contacts and tilts at least a portion of the at least one guiding element in the direction of the second module such that the at least one guiding element at least temporarily contacts a surface of the boundary wall facing the first module.

14. The device of claim 13, wherein the second module is a safe for receiving cash boxes of an automated teller machine; and wherein the first module is a head module of the automated teller machine including an input and an output unit for the notes of value.

15. The device of claim 14, wherein the head module is displaceable relative to the safe; and wherein in the first operating configuration the notes of value can be deposited or withdrawn.

16. The device of claim 13, wherein the at least one guiding element includes at least two spaced-apart guiding fingers configured to guide the notes of value; and wherein the transport mechanism of the first module includes at least one transport element that is at least partially arranged between the at least two guiding fingers in the first operating configuration.

17. The device of claim 13, wherein the at least one guiding element is rotatably mounted about a rotational axis extending transversely to a direction in which the first and the second modules are movable relative to each other.

18. The device of claim 17, wherein in the first and the second operating configurations the at least one guiding element is held by at least one spring in the operating position; and wherein when the first and the second modules are moved relative to each other the first module rotates the at least one guiding element against spring force of the at least one spring about the rotational axis in the direction of the second module.

19. The device of claim 18, wherein the at least one guiding element includes a shaft with a longitudinal axis that coincides with the rotational axis, and at least two guiding fingers connected to the shaft in a rotationally fixed manner.

20. The device of claim 13, wherein the first module is slidably movable with respect to the second module.

* * * * *